US005101605A

United States Patent [19]

Masuyama et al.

[11] Patent Number: 5,101,605

[45] Date of Patent: Apr. 7, 1992

[54] DOMED STRUCTURES HAVING RETRACTABLE ROOFS

[75] Inventors: Joe Masuyama; Koji Mikuriya; Tsuneo Takai; Shinji Chiba; Kiyoshi Hotta; Yoshinori Hamano; Katsuyuki Onishi; Koji Funahashi; Yuji Takahashi; Junichi Sugawara, all of Tokyo, Japan

[73] Assignee: Tobishima Corporation, Tokyo, Japan

[21] Appl. No.: 418,639

[22] Filed: Oct. 10, 1989

[30] Foreign Application Priority Data

Feb. 9, 1989 [JP] Japan ..... 1-30528

[51] Int. Cl.[5] ..... E04B 1/346

[52] U.S. Cl. ..... 52/66; 52/64

[58] Field of Search ..... 52/66, 63, 69, 83, 64, 52/80, 169.7, 169.1, 742, 169.6

[56] References Cited

U.S. PATENT DOCUMENTS 4,676,033 6/1987 Allen et al. ..... 52/66 X 4,738,057 4/1988 Logan ..... 52/66 X

FOREIGN PATENT DOCUMENTS 44-15346 7/1969 Japan ..... 52/66

OTHER PUBLICATIONS

Earth Sheltered Housing Design, p. 208, 1979, Van Nostrand Reinhold Co.

*Primary Examiner*—David A. Scherbel

*Assistant Examiner*—Creighton Smith

*Attorney, Agent, or Firm*—Wenderoth, Lind & Ponack

[57] ABSTRACT

A domed structure having a retractable roof comprises a field area obtained by digging out a hollow, substantially concave in section, in the ground and levelling the bottom of the hollow seats for the spectators are provided by extending an upward slope outwardly from the end of the field area in an endless manner, and a movable roof element is movably mounted on a rail element laid out on the ground adjacent to the peripheral edge of said hollow. The movable roof element includes a driving arrangement to be placed on the rail element. The rail element may be tilted with a gradient rising toward the direction of solar radiation.

9 Claims, 5 Drawing Sheets

DOMED STRUCTURES HAVING RETRACTABLE ROOFS

FIELD OF THE INVENTION

The present invention relates to a domed structure having a retractable roof, which is used for sports fields.

BACKGROUND OF THE INVENTION

In recent years, there has been increased demand for attending or conducting sports, which originally were to be practiced in the open, regardless of weather conditions, esp., without being subjected to the influence of rainy weather. It has also been demanded to extend the season for outdoor sports activities to all the year round. Thus, massive domed buildings having a roof have been constructed in urban areas.

However, a problem with such massive domes having a roof is that even when it does not rain, they remain so roofed that their indoor atmosphere is rather a drawback as compared with a roofless sports field, because the roof above gives a sense of oppression to the spectators and players inside.

In view of such a problem, retractable roofs have been devised and proposed to expose the interior of the dome to the open air.

Until now have there been typically available sports fields having two types of movable roofs, one type being a completely slidable rectangular roof and the other type being a round roof movable in the manner of a camera lens shutter.

However, although used exclusively for small sports fields such as tennis courts, both types of roofs are not still applied to large sports fields such as baseball or soccer fields. The reasons are that, when applied to large sports fields, the known retractable roofs leave something to be desired in relation to the construction and maintenance costs, the construction techniques, the structural safety and the like.

In view of the above problem, it is therefore an object of the present invention to provide a domed structure having a massive retractable roof which is inexpensive to construct and maintain and needs no special room for housing the retractable roof, and in which the retractable roof is of sufficient structural strength and safety when applied to a large sports field and is smoothly movable with an increased opening ratio.

SUMMARY OF THE INVENTION

According to one aspect of the present invention, there is provided a domed structure having a retractable roof, which comprises in combination:

a field area obtained by digging out a hollow substantially concave in section in the ground and levelling the bottom of the hollow, seats for the spectators set up by extending an upward slope outwardly from the end of the field area in an endless manner, and a rail element laid out on the ground adjacen to the peripheral edge of the hollow, on which a movable roof element is to be placed, the movable roof element including driving means to be placed on the rail element.

According to another aspect of the present invention, there is provided a domed structure having a retractable roof, which comprises in combination:

a field area obtained by digging out a hollow substantially concave in section in the ground and levelling the bottom of the hollow, seats for the spectators set up by extending an upward slope outwardly from the end of said field area in an endless manner, and a rail element laid out on the ground adjacent to the peripheral edge of the hollow, on which a movable roof element is to be placed and which is inclined with a gradient rising toward the direction of solar radiation, the movable roof element including driving means to be placed on the rail element.

BRIEF DESCRIPTION OF THE DRAWINGS

Embodiments of the present invention will now be explained specifically but not exclusively with reference to the accompanying drawings, in which.

PREFERRED EMBODIMENTS OF THE INVENTION

Figure 1:
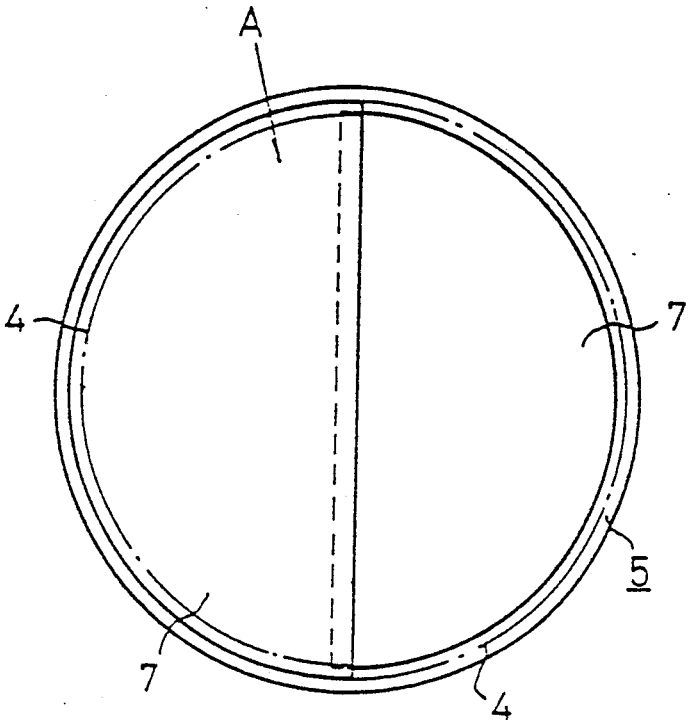
FIG. 1 is a schematic plan view of the first embodiment of a domed structure having a retractable roof.

Referring now to the drawings, a hollow, substantially concave in section, is shown at 1.

The hollow 1 is obtained by digging the ground in a circular form, and is levelled over its bottom to set up a field area 2.

An upward slope extending outwardly from the peripheral edge of the field area 2 is laid out in ringed form to set up seats 3 for spectators.

Laid out on the ground adjacent to the peripheral edge of the hollow 1 is a rail element 5 on which ringed or annular tracks 4 are to be placed. Attached to the annular tracks 4 mounted on the rail element 5 are driving means, such as driving wheels, for moving a movable roof element.

With such an arrangement, it is possible to bear the loads of relatively heavy movable split roof elements on the ground with no need of providing any special structure. More specifically, the present invention takes a new over-all look at the established conception that a roof is mounted on a firm high-rise structure erected up, and so successfully provides a domed structure having a retractable roof, which is inexpensive to construct, etc.

Figure 2:
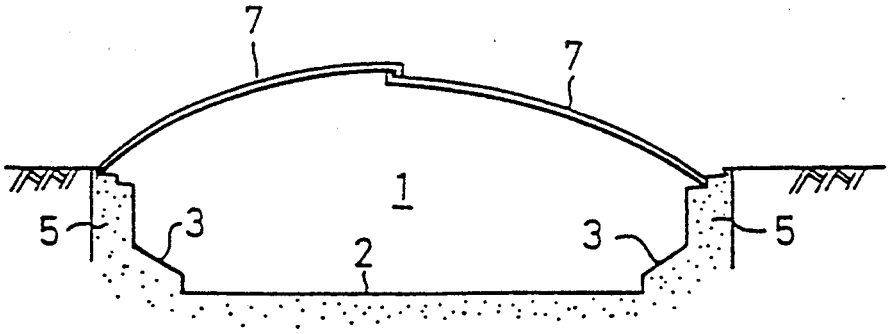
FIG. 2 is a schematic section of FIG. 1, FIGS. 3 and 4 are schematic sections showing a second embodiment of the present invention.
Figure 6:
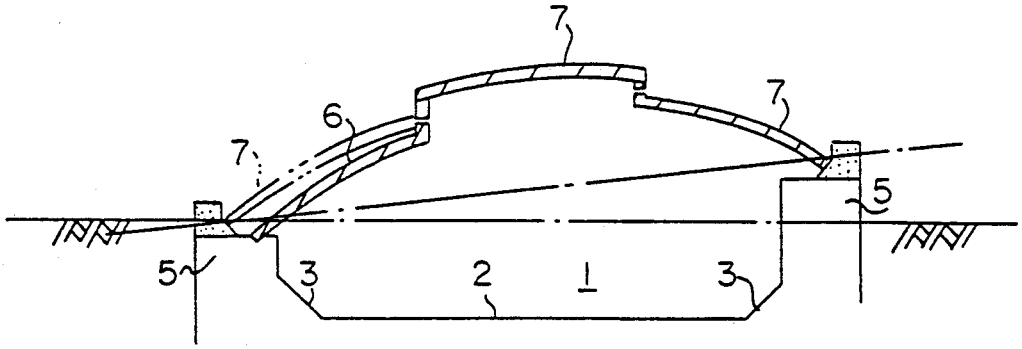
FIGS. 6 and 7 are schematic sections of FIG. 5.
Figure 7:
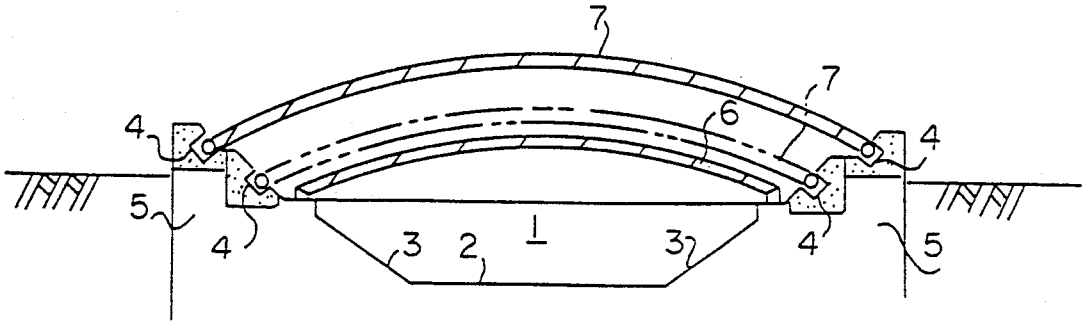
Figure 8:
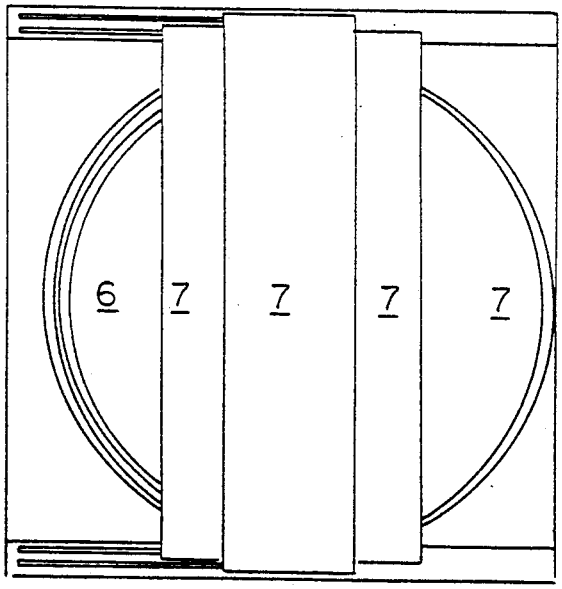
FIG. 8 is a schematic plan view showing a domed structure having five roof elements according to the second embodiment of the present invention.
Figure 9:
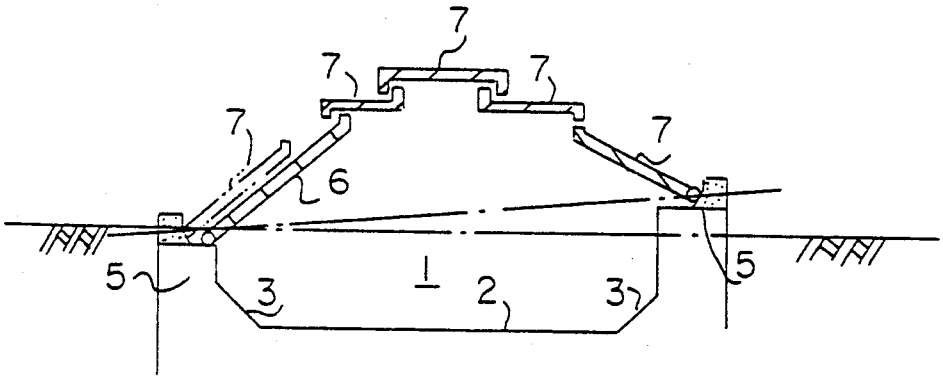
FIGS. 9 and 10 are schematic sections of the domed structure having five roof elements according to the second embodiment of the present invention.
Figure 10:
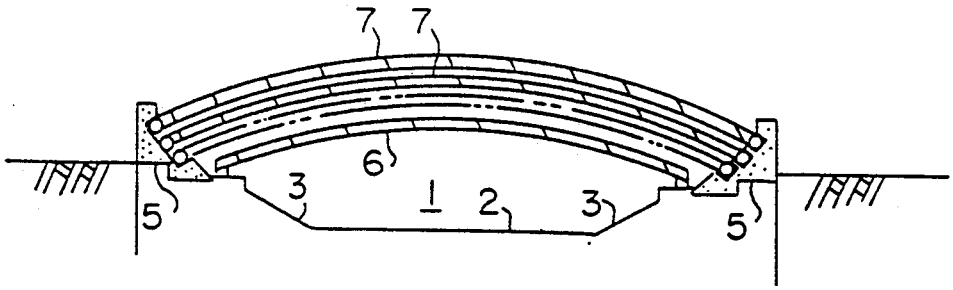

It is understood that any limitation is not imposed on the number of split roof elements A at all. As illustrated in FIG. 2, two movable split roof elements A may be used. Alternatively, use may be made of one fixed roof element 6 in a semi-vaulted form with one movable roof element 7 again in semi-vaulted form and one gate type movable roof element 7, three in all, as depicted in FIG. 6. Still alternatively, one fixed roof element 6 may be used together with four movable roof elements A, five in all, as shown in FIG. 9.

An embodiment according to the second aspect of the present invention will now be explained.

Figure 3:
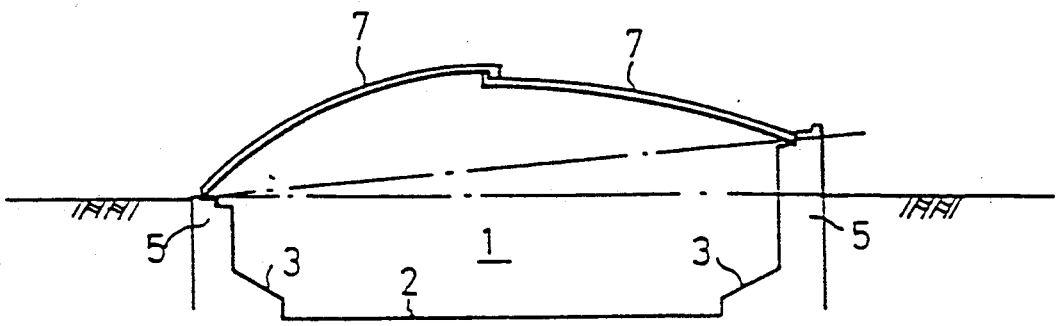
Figure 4:
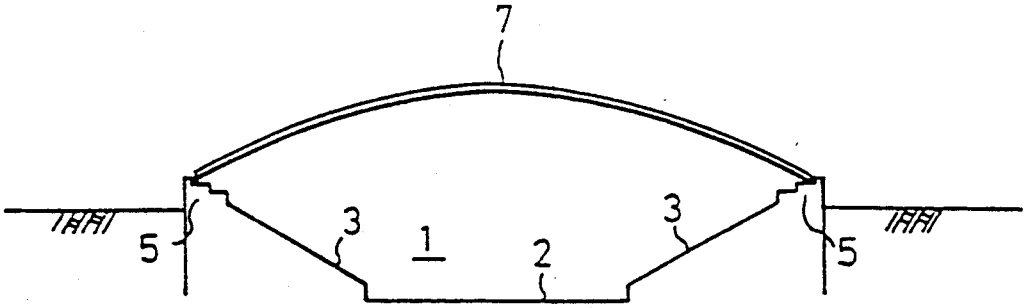
Figure 5:
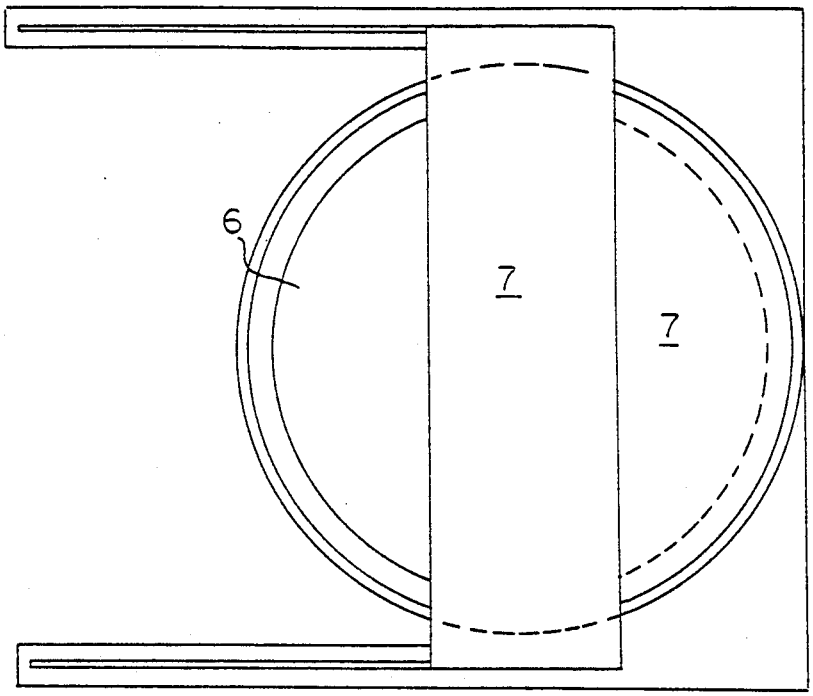
FIG. 5 is a schematic plan view illustrating a domed structure having three roof elements.

As can be seen from FIG. 3, a rail element 5 laid out on the ground adjacent to the peripheral edge of the hollow 1, on which annular tracks 4 for moving movable roof elements are to be placed, is inclined with a gradient rising toward the direction of solar radiation. With such an arrangement, it is possible to align the opening zone with the direction of solar radiation, thereby allowing sunlight to go deep in the interior of the domed structure and so assuring an area of solar radiation wider than that achievable at an actual opening ratio.

The second embodiment of the present invention is applicable to three or five roof elements alike. The rail element 5 having the annular tracks 4 laid out thereon is inclined with a gradient rising toward the direction of solar radiation, thereby obtaining an insolation higher than that achievable at an actual opening ratio.

The domed structure having a retractable roof according to the present invention is of such a structure as mentioned above.

With the domed structure according to the present invention, it is possible to attend or conduct outdoor sports in the natural environment when the weather is fine and in an indoor environment provided by closing the roof in case of wet weather.

Since the rail element having the annular tracks laid out thereon or the substructure supporting them is located below the surface of the ground, the structural safety of the domed structure is so high that any firm high-rise structure for supporting the rail element can be dipensed with, resulting in a cutdown of the construction cost.

The present domed structure has an additional advantage of being so low in height that it is in keeping with surroundings.

Further, the present invention is very advantageous for setting up a support structure in regions where the foundation is shallow.

Still further, an area of solar radiation larger than that achieved at an actual opening ratio can be obtained according to the present invention, since the annular tracks are tilted with a gradient rising with respect to the direction of solar radiation.

What is claimed is:

1. A structure having a retractable roof, comprising:
a field area on a level bottom surface of a hollow in the ground, said hollow being concave and formed by digging below the surface level of the ground, and said hollow having a peripheral edge;
a spectator seating area comprising an upward slope sloping upwardly from said field area;
a rail element disposed adjacent to said peripheral edge of said hollow such that said rail element is at least partially supported by the ground defining said hollow; and
a roof comprising a movable roof element movably mounted on said rail element, said movable roof element having driving means for engagement with said rail element enabling said movable roof element to move on said rail element.

2. A structure having a retractable roof, comprising:
a field area on a level bottom surface of a hollow in the ground, said hollow being concave and formed by digging below the surface level of the ground, and said hollow having a peripheral edge;
a spectator seating area comprising an upward slope sloping upwardly from said field area;
a rail element disposed adjacent to said peripheral edge of said hollow such that said rail element is at least partially supported by the ground defining said hollow, said rail element having a gradient relative to the horizontal rising from one side of said hollow towards an opposite side of said hollow in a direction of solar radiation; and
a roof comprising a movable roof element movably mounted on said rail element, said movable roof element having driving means for engagement with said rail element enabling said movable roof element to move on said rail element.

3. The structure as set forth in claim 1 or 2, wherein said hollow is circular about said peripheral edge.

4. The structure as set forth in claim 1 or 2, wherein said rail element has annular tracks for said driving means of said movable roof element.

5. The structure as set forth in claim 1 or 2, wherein said roof further comprises at least one additional movable roof element movably mounted on said rail element.

6. The structure as set forth in claim 1 or 2, wherein said roof further comprises a fixed semi-vaulted roof element disposed so as to cover a portion of said hollow.

7. The structure as set forth in claim 6, wherein said roof further comprises a linearly movable gate roof element.

8. The structure as set forth in claim 1 or 2, wherein said movable roof element is semi-vaulted.

9. The structure as set forth in claim 1 or 2, wherein said movable roof element is semi-vaulted and annularly movable about said peripheral edge of said hollow on said rail element, and said roof further comprises a fixed semi-vaulted roof element and a linearly movable semi-vaulted gate roof element.

* * * * *